United States Patent [19]

Kinase et al.

[11] 4,416,742

[45] Nov. 22, 1983

[54] PROCESS AND ELECTROLYTIC BATH FOR MAKING A RHODIUM-PLATED ARTICLE HAVING A BLACK OR BLUE COLOR

[75] Inventors: Takashi Kinase, Hitachi; Seiji Ichimura, Katsuta; Yoshio Kinjo, Narashino; Yosuke Matsumoto, Chiba, all of Japan

[73] Assignees: Nippon Mining Co., Ltd.; Nippon Metal Plating Co., Ltd., both of Tokyo, Japan

[21] Appl. No.: 304,939

[22] Filed: Sep. 23, 1981

[30] Foreign Application Priority Data

| | | | |
|---|---|---|---|
| Sep. 25, 1980 | [JP] | Japan | 55-134038 |
| Sep. 25, 1980 | [JP] | Japan | 55-134039 |
| Sep. 25, 1980 | [JP] | Japan | 55-134040 |

[51] Int. Cl.[3] ..... C25D 3/50; C25D 3/52

[52] U.S. Cl. ..... 204/47; 204/43 P

[58] Field of Search ..... 204/47, 43 P; 106/1.28; 428/670; 427/437

[56] References Cited

U.S. PATENT DOCUMENTS

| | | | |
|---|---|---|---|
| 1,981,820 | 11/1934 | Zimmermann | 204/47 |
| 2,057,475 | 10/1936 | Cohn | 204/47 |
| 2,067,534 | 1/1937 | Keitel | 204/47 |
| 3,729,396 | 4/1973 | Browning et al. | 204/47 |

FOREIGN PATENT DOCUMENTS

| | | | |
|---|---|---|---|
| 692122 | 6/1940 | Fed. Rep. of Germany | 204/47 |
| 52-24131 | 2/1977 | Japan | 204/47 |
| 446393 | 4/1936 | United Kingdom | 204/47 |
| 198082 | 7/1967 | U.S.S.R. | 204/47 |
| 285437 | 1/1971 | U.S.S.R. | 204/47 |

*Primary Examiner*—G. L. Kaplan

*Attorney, Agent, or Firm*—Burns, Doane, Swecker & Mathis

[57] ABSTRACT

A rhodium-plated article with black or blue color is obtained through electroplating by using a plating bath comprising a conventional acid rhodium bath and an additive consisting of organocarboxylic acid, aromatic sulfonic acid or salts of these, amine, gelatin, butynediol, hypophosphite or a mixture thereof.

12 Claims, No Drawings

PROCESS AND ELECTROLYTIC BATH FOR MAKING A RHODIUM-PLATED ARTICLE HAVING A BLACK OR BLUE COLOR

BACKGROUND

The present invention relates to a novel article which is plated with rhodium developing black or blue color, a process for making the same and a novel bath for rhodium-plating.

All the colors of the platings which are obtainable through known rhodium-plating baths are white, the known rhodium baths comprising various rhodium salts, e.g., sulfate or phosphate.

Rhodium-plating has been generally employed for use in electric contacts, lead frames and ornamental articles due to its good hardness, wear resistance, corrosion or erosion resistance and stability in the contact resistance. Furthermore, it has been desired to develop rhodium plating with different colors besides white, as it will enhance the practical value of the rhodium plating.

On the other hand, known manners for black plating or black coloring such as black chrome plating, black nickel plating, blackening with copper carbonate all encounter difficulties in obtaining gloss, some of them yielding clouding, that is to say, these all being less valuable in the ornamental effect. There have been further problems in the manufacturing process, wherein they showed bad reproducibility in operation conditions, difficulties in mass production or the like. Thus there has been much to be desired in the prior art and it has long been desired to develop black color plating of noble metal in the ornamental article industries.

SUMMARY OF THE INVENTION

Accordingly, an object of the present invention is to provide a noble rhodium-plated article having a black or blue color as well as mirror-like gloss.

Another object of the present invention is to provide a process and a plating bath for making such rhodium-plated article with black or blue color.

Still further objects of the invention will become apparent from the disclosure hereinbelow.

The inventors have become aware of following fact after investigations for developing a bath composition for plating ("plating bath" or "bath" hereinafter) which provides a plating suitable for ornamental articles, particularly glasses, watches, accessories, cosmetics or dinner wares: rhodium-plating with black or blue color and mirror-like gloss is obtainable through a normal plating manner in an acid rhodium-plating bath comprising an additive consisting of at least one selected from the group consisting of organocarboxylic acids, aromatic sulfonic acids or salts of these, amine, gelatin, butynediol and hypophosphite, the resultant rhodium-plating providing good adhesion and good corrosion or erosion resistance. Based on such finding, the inventors have completed the present invention.

The rhodium-plated articles of the present invention are suitable for, e.g., frames of glasses, cases, faces and bands of watches, necktie pins, lighters, necklaces, rings, compacts, caps for lipsticks and the like. The articles of the present invention may be utilized not only in the ornamental purpose but in various fields which require such a good plated coating.

The present invention will be described hereinbelow with reference to preferred embodiments which will, however, serve to better illustration of the invention and not to limitation thereof. Modifications may be done without departing from the gist of the present invention.

DETAILED DESCRIPTION OF THE INVENTION

The plating bath of the present invention comprises a normal acid rhodium plating bath comprising rhodium salt and free acid (known per se), and an additive consisting of at least one selected from the group consisting of organocarboxylic acids, aromatic sulfonic acids or salts of these, amine, gelatin, butynediol and hypophosphite (referred to "additive" hereinafter). This plating bath is used for plating treatment of the articles resulting in rhodium-plated articles with desired properties.

Normally, the plating bath comprising three ingredients of rhodium salt, free acid and the additive such as organocarboxylic acid hereinabove mentioned will be sufficient for accomplishing the purpose of the present invention.

Rhodium salts which are normally used in the conventional rhodium plating, e.g., sulfate, phosphate, sulfamic acid and the like are employed as the rhodium salt for the plating bath.

The rhodium salt concentration in the bath ranges within a conventional, normal concentration, i.e., from 0.1 g/l to 20 g/l. At a concentration below 0.1 g/l the speed of electrodeposition will be undesirably reduced. At a concentration exceeding 20 g/l the expensive rhodium would be used without effective utilization.

The free acid encompasses acids which are normally used in the acid plating bath, such as sulfuric acid, phosphoric acid, sulfamic acid and the like.

Among the additives of the invention, organocarboxylic acid and aromatic sulfonic acid are used in either a free acid form or a salt form, only one of these being sufficient, however, two or more being applicable. The terms organocarboxylic acid or aromatic sulfonic acid denote also their salts hereinafter. Such salts encompass sodium or potassium salts.

The concentration of organocarboxylic acid and/or aromatic sulfonic acid should be determined relating to the concentration of rhodium, and, however, be not less than 0.01 g/l, a lower concentration of which would deterioratingly affect upon color development. These additives may be added to the bath up to a solubility limit in the bath, however, used at a concentration with is practically sufficient.

Organocarboxylic acid of the invention encompasses acetic acid and benzoic acid which have only one carboxylic group and no other functional group, phthalic acid and thiomalic acid which have two carboxylic groups, and salts of each.

The concentration of aromatic sulfonic acid in the bath approximates to that of organocarboxylic acid. Aromatic sulfonic acid encompasses benzenesulfonic acid, nitrobenzenesulfonic acid, phenolsulfonic acid, metanilic acid or the like and salts of these acids.

The additives to the bath in the present invention further encompasses amine, gelatin and butynediol. Amine encompasses ethylenediamine, triethanolamine, sulfuric hydroxylamine, diethylenetriamine or the like. One amine among those as the additive is sufficient, however two or more amines or amine(s) with other additives may be used.

The concentration of amine, gelatin and butynediol in the bath approximates to that of organocarboxylic acid.

Hypophosphite as the additive encompasses alkali metal salts (sodium or potassium salt), alkaline earth metal salts (calcium or magnesium salt), other divalent metal salts (Co-, Ni-, Fe- or Mn- salt) and the like. Among those salts alkali metal salts or alkaline earth metal salts are preferred.

The concentration of hypophosphite as the additive in the bath approximately ranges from 0.5 to 10 g/l. A lower concentration less than 0.5 g/l does not develop sufficient effect, and that exceeding 10 g/l would cause to get cloudy, i.e., to loose the gloss. This additive of hypophosphite requires slightly different conditions of plating with respect to pH, bath temperature or the like from the other additives aforementioned. For hypophosphite the pH should be below 2.5 as a higher pH would cause cracks or precipitation in the bath. An optimum temperature for hypophosphite approximately ranges from 20° to 45° C. A higher temperature exceeding 45° C. is not preferred as it enhances the possibility of the partial clouding. However, the current density at a conventional, normal range (e.g., approximately 0.5–5 A/dm$^2$) may be adopted.

The additives as hereinabove mentioned belong to essential ingredients of the bath according to the present invention, however, a further agent as a brightener may be added to the bath, i.e., 0.1–10 mg/l of nonionic surfactant may be used. Such nonionic surfactants encompass that of the ether type, e.g., polyoxyethylenealkylether, polyoxyethylenealkylphenylether or the like, which are generally used as the brightener in the prior art, however, further serve to inhibit the plating from forming microcracks, partial clouding and to produce a uniform color tone.

Again turning to the additives of the invention other than hypophosphite, the pH value of the bath should not exceed 6. At a higher pH value than 6, rhodium in the bath will form hydroxide to form precipitation to disadvantage.

The color of the rhodium-plated coating or film relates to the thickness thereof, wherein a thinner coating will produce blue color while a thicker coating black color. Provided that benzoic acid is used as organocarboxylic acid, the plating of the thickness less than 0.05 micron produces the blue color, whereas the thickness of 0.1 micron or more produces the black color, and the thickness between 0.05 and 0.1 micron will produce bluish black color. The thickness of 5 microns shows still the black color. Other organocarboxylic acid develops also the similar results in the color as well as the other additives aforementioned.

In the practical operation, it is also affected by plating conditions, whether the plating becomes black or blue, the plating conditions encompassing concentrations in the bath of the rhodium salt and the additive(s), bath temperature current density, plating time, and the like. Such factors should be determined through a preparatory test plating under consideration such factors. In the practical plating procedure, the control or choice of the color is preferably made mainly by changing the plating time under a predetermined bath condition.

The bath temperature and current density for plating procedure are adopted within the values as adopted in the conventional manner. A bath temperature of 10°–80° C. should be adopted. At a lower temperature less than 10° C., the current density will not sufficiently rise resulting in the low electrodeposition efficiency. At a temperature higher than 80° C., the disadvantage of excessive vaporization of the bath will overcome the advantage of enhancement in the electrodeposition efficiency. The current density having close relation with the color tone should be 0.1–10 A/dm$^2$. A higher current density than 10 A/dm$^2$ will cause excessive generation of gas at a cathode in the bath accompanied by a deteriorated color tone.

Materials for anode and cathode which are employed upon rhodium plating in the prior art may be used. The cathode may be selected from known material having a metallic surface such as brass, German silver (nickel silver), stainless steel or the like (however, iron, aluminium and zinc cannot be plated directly thereon). The cathode material further encompasses articles coated with strike (substrate coating), e.g., nickel strike or palladium nickel strike. The cathode material encompasses also non-metallic articles coated with such substrate coating.

One of insoluble electrodes is sufficient for the anode, e.g., platinum electrode, titanium electrode coated with platinum or platinum-rhodium plating.

Other known manner generally applicable to the plating process may be optionally applied in the plating procedure in the present invention.

The article thus obtainable according to the present invention, however, has the mirror-like gloss with its surface, the black or blue color, good adhesion, good corrosion or erosion resistance, and the hardness compatible with the conventional rhodium plated articles without applying other conventional agents for various purposes. In other words, the rhodium-plated article with the black or blue color is obtainable through applying a bath essentially consisting of three ingredients, i.e., rhodium salt, free acid and the additive of the invention, the additive being organocarboxylic acid, aromatic sulfonic acid or one of other members aforementioned.

Thus the present invention is applicable in the industry with advantage.

Now, in the following, the present invention will be described in more detail by way of preferred embodiments thereof, which will not serve to limitation of the invention.

EXAMPLE 1.

In a bath of pH 4.0 obtained by mixing rhodium sulfate (rhodium: 4 g/l), phthalic acid (2 g/l) and sulfuric acid were set a titanium anode plated with platinum and a cathode of a brass watch case plated with a nickel strike. The watch case was electroplated for ten minutes under conditions of a bath temperature of 30° C. and a current density of 0.5 A/dm$^2$.

The resultant plated film presented black color and mirror-like gloss provided with 0.3 micron thickness and good adhesion.

The same article was electroplated for one minute under the same conditions. The resultant plated film was 0.03 micron thick provided with mirror-like gloss and blue color.

The resultant watch case was tested with respect to the corrosion resistance through a CAS-testing manner and exposure testing in an ammonia atmosphere as follows: sample pieces were put in a desicator, charged with ammonia water of the density 0.96 on the bottom, the sample pieces were kept therein at 20° C. for 24 hours exposed to an ammonia atmosphere. After the exposure, color change and bulging in the surface were observed. No corrosion was observed thus exhibiting the good corrosion resistance. The articles showed a hardness compatible with the level of the rhodium-plated white coating according to the conventional manner.

EXAMPLES 2-8.

Rhodium-plating was carried out under the conditions as shown in Table 1 otherwise in the same condition as disclosed in Example 1, the results being also disclosed in Table 1. All the sample pieces showed properties equivalent to those of Example 1 with respect to the mirror-like gloss, corrosion resistance, hardness and adhesion.

TABLE 1

| Example No. | bath composition | | concentration g/l | bath temperature °C. | current density A/dm² | cathode | plating time min. | plating thickness μ | color |
|---|---|---|---|---|---|---|---|---|---|
| 2 | Rh—sulfate | (Rh) | 4 | 30 | 0.5 | stainless steel | 20 | 0.4 | black |
| | benzoic acid | | 2 | | | frame of glasses | | | |
| | sulfuric acid | total | 12 | " | " | with Pd—Ni strike | 2 | 0.04 | blue |
| 3 | Rh—sulfate | (Rh) | 2 | 50 | 2 | stainless steel | 10 | 0.2 | black |
| | thiomalic acid | | 1 | | | necktie pin with | | | |
| | sulfuric acid | total | 6 | " | " | Ni strike | 1.5 | 0.03 | blue |
| 4 | Rh—sulfate | (Rh) | 2 | 50 | 0.5 | brass plate with | 5 | 0.2 | black |
| | acetic acid | | 20 ml/l | | | Ni strike | | | |
| | sulfuric acid | total | 6 | " | 1 | | 1 | 0.04 | blue |
| 5 | Rh—phosphate | (Rh) | 4 | 50 | 1 | brass plate | 20 | 0.5 | black |
| | K—benzoate | | 3 | | | (10 cm²) | | | |
| | phosphoric acid | total | 12 | " | " | | 2 | 0.05 | blue |
| 6 | Rh—sulfate | (Rh) | 2 | | | brass plate with | | | |
| | K—phthalate | | 1 | 30 | 0.5 | Pd—Ni strike | 20 | 0.3 | black |
| | K—benzoate | | 2 | | | | | | |
| | sulfuric acid | total | 6 | | | | | | |
| 7 | Rh—sulphate | (Rh) | 2 | 50 | 1 | gold flash plated | 10 | 0.1 | black |
| | Na—acetate | | 30 | | | German silver | | | |
| | sulfuric acid | total | 12 | | | | | | |
| 8 | Rh—sulfate | (Rh) | 2 | 50 | 0.5 | brass plate | 1 | 0.02 | blue |
| | K—thiomalate | | 25 | | | | | | |
| | sulfuric acid | total | 50 | | | | | | |

EXAMPLE 9

In a bath obtained by mixing rhodium sulfate (rhodium: 2 g/l), o-nitrobenzenesulfonic acid (10 g/l) and sulfuric acid (total: 6 g/l) were set the same anode as used in Example 1 and a cathode of a stainless steel watch case with a nickel strike. The watch case was electroplated for 10 minutes under conditions of a bath temperature of 50° C. and the current density of 1 A/dm².

The resultant plating film presented black color with mirror-like gloss. The film was 0.5 micron thick having good adhesion.

After one minute electroplating otherwise under the same conditions, a 0.05 micron thick plating with mirror-like gloss was obtained.

Testing in the manner as disclosed in Example 1 revealed the good corrosion resistance and a hardness compatible with conventional white rhodium plating.

EXAMPLE 10-17

Rhodium plating was carried out under conditions as shown in Table 2 otherwise under the same conditions as disclosed in Example 9, the results being also disclosed in Table 2. The resultant platings showed mirror-like gloss, the good corrosion resistance and hardness.

TABLE 2

| Example No. | bath composition | | concentration g/l | bath temperature °C. | current density A/dm² | cathode | plating time min. | plating thickness μ | color |
|---|---|---|---|---|---|---|---|---|---|
| 10 | Rh—sulfate | (Rh) | 2 | 50 | 1 | stainless steel | 20 | 0.15 | black |
| | benzenesulfonic acid | | 10 | | | frame of glasses with Pd—Ni strike | | | |
| | sulfuric acid | total | 6 | | | | 5 | 0.04 | blue |
| 11 | Rh—sulfate | (Rh) | 4 | 50 | 2 | brass plate | 10 | 0.14 | black |
| | metanilic acid | | 1 | | | with Ni strike | | | |
| | sulfuric acid | total | 30 | | | | 2 | 0.03 | blue |
| 12 | Rh—sulfate | (Rh) | 2 | 50 | 0.5 | brass plate | 10 | 0.35 | black |
| | o-phenolsulfonic acid | | 1 | | | | | | |
| | sulfuric acid | total | 45 | | | | 1 | — | blue |
| 13 | Rh—sulfate | (Rh) | 4 | 30 | 2 | gold flash-plated brass plate | 5 | 0.6 | black |
| | Na—o-nitro-benzenesulfonate | | 15 | | | | | | |
| | sulfuric acid | total | 40 | | | | ¼ | — | blue |
| 14 | Rh—phosphate | (Rh) | 2 | 50 | 1 | stainless watch case with Ni strike | 5 | 0.3 | black |
| | Na—benzenesulfonate | | 15 | | | | | | |
| | phosphoric acid | total | 50 | | | | ½ | — | blue |
| 15 | Rh—sulfate | (Rh) | 2 | 50 | 1 | frame of glasses with Pd—Ni strike | 10 | 0.3 | black |
| | K—metanilate | | 1 | | | | | | |
| | sulfuric acid | total | 12 | | | | 1 | 0.03 | blue |
| 16 | Rh—sulfate | (Rh) | 3 | 60 | 1 | brass plate | 5 | 0.6 | black |
| | Na—o-phenol-sulfonate | | 1 | | | | | | |
| | sulfuric acid | total | 50 | | | | ½ | 0.03 | blue |

TABLE 2-continued

| Example No. | bath composition | concentration g/l | bath temperature °C. | current density A/dm² | cathode | plating time min. | plating thickness μ | color |
|---|---|---|---|---|---|---|---|---|
| 17 | Rh—sulfate | (Rh) 2 | 50 | 0.5 | brass plate with Ni strike | 5 | 0.35 | black |
| | Na—benzenesulfonate | 10 | | | | | | |
| | Na—o-phenol-sulfonate | 0.5 | | | | ½ | 0.04 | blue |
| | sulfuric acid | total 50 | | | | | | |

EXAMPLE 18

Electroplating with rhodium was carried out under the conditions as shown in Table 3, otherwise under the same condition as in Example 1. The resultant plating film was 0.1 micron thick having good adhesion.

The good corrosion resistance was exhibited through the same testing as in Example 1, and the hardness compatible with the conventional white rhodium plating was exhibited.

By electroplating for 4 minutes otherwise under the same conditions as above, the resultant plating developed blue color provided with the thickness of 0.02 micron and other good properties as in the black rhodium plating.

EXAMPLES 19-23

Rhodium plating was carried out under conditions as shown in Table 3 otherwise under the same conditions as in Example 1, the results being also disclosed in Table 3. The resultant platings showed the mirror-like gloss, the good corrosion-resistance and hardness as in Example 18.

TABLE 3

| Example No. | bath composition | concentration g/l | bath temperature °C. | current density A/dm² | cathode | plating time min. | plating thickness μ | color |
|---|---|---|---|---|---|---|---|---|
| 18 | Rh—sulfonate | (Rh) 2 | 50 | 0.5 | stainless watch case with Ni strike | 20 | 0.1 | black |
| | triethanolamine | 1 ml/l | | | | | | |
| | sulfuric acid | total 6 | | | | 4 | 0.02 | blue |
| 19 | Rh—phosphate | (Rh) 2 | 50 | 2 | stainless watch case with Ni—Pd strike | 5 | 0.3 | black |
| | ethylenediamine | 50 ml/l | | | | | | |
| | phosphoric acid | total 50 | | | | ½ | 0.03 | blue |
| 20 | Rh—sulfate | (Rh) 2 | 30 | 2 | brass plate with Ni—strike | 10 | 0.38 | black |
| | gelatine | 0.4 | | | | | | |
| | sulfuric acid | total 6 | | | | 1 | 0.04 | blue |
| 21 | Rh—sulfate | (Rh) 2 | 50 | 2 | brass plate | 5 | 0.3 | black |
| | butynediol | 2 | | | | | | |
| | sulfuric acid | total 6 | | | | ½ | 0.03 | blue |
| 22 | Rh—sulfate | (Rh) 3 | 25 | 3 | brass plate | 10 | 0.5 | black |
| | Na—hypophosphite | 1 | | | | | | |
| | sulfuric acid | free 10 | | | | | | |
| 23 | Rh—sulfate | (Rh) 3 | 25 | 3 | brass plate | 10 | 0.5 | black |
| | Co—hypophosphite | 1 | | | | | | |
| | sulfuric acid | free 10 | | | | | | |
| 24 | Rh—sulfuric acid | (Rh) 3 | 25 | 3 | brass plate | 10 | 0.5 | black |
| | Ni—hypophosphite | 1 | | | | | | |
| | sulfuric acid | free 10 | | | | | | |

We claim:

1. A process for electroplating rhodium onto a conductive substrate which process comprises:

(1) providing an aqueous acidic rhodium plating bath comprised of (a) a free acid, (b) a source of rhodium in a concentration ranging from about 0.10 to 20 g/l based on the rhodium metal, and (c) at least one additive selected from the group consisting of thiomalic acid and salts thereof, phthalic acid and salts thereof, butynediol and hypophosphite, said additive being present in an amount of at least about 0.01 g/l, with the pH of said bath not exceeding 6; and (2) electroplating rhodium onto said substrate as a cathode in said bath under conditions such that the rhodium is plated in the form of a blue or black electroplate.

2. The process as defined in claim 1, wherein said hypophosphite is present in an amount ranging from about 0.5 to 10 g/l.

3. The process as defined in claim 1, wherein said free acid is selected from the group consisting of sulfuric acid, phosphoric acid and sulfamic acid.

4. The process as defined in claim 1, wherein said hypophosphite is selected from the group consisting of an alkali metal salt, an alkaline earth metal salt, a divalent metal salt other than an alkaline earth metal salt, or mixtures thereof.

5. The process as defined in claim 1 wherein said additive is one selected from the group consisting of thiomalic acid and salts thereof, phthalic acid and salts thereof, and butynediol.

6. The process as defined in claim 1, wherein said additive is hypophosphite and the pH value of the bath does not exceed 2.5.

7. An aqueous acidic rhodium electroplating bath comprised of (a) a free acid, (b) a source of rhodium in a concentration ranging from about 0.10to 20 g/l based on rhodium metal, and (c) at least one additive selected from the group consisting of thiomalic acid and salts thereof, phthalic acid and salts thereof, butynediol and hypophosphite, said additive being present in an amount of at least about 0.01 g/l, with the pH of said bath not exceeding 6.

8. The rhodium plating bath as defined in claim 7, wherein said additive is selected from the group consisting of thiomalic acid and salts thereof, phthalic acid and salts thereof and butynediol.

9. The rhodium plating bath as defined in claim 7, wherein said additive is hypophosphite and the pH value of the bath does not exceed 2.5.

10. The rhodium plating bath as defined in claim 7, wherein said hypophosphite is selected from the group consisting of an alkali metal salt, an alkaline earth metal salt, a divalent metal salt other than an alkaline earth metal salt or mixtures thereof.

11. The rhodium plating bath as defined in claim 7, wherein said hypophosphite is present in an amount ranging from about 0.5 to 10 g/l.

12. The rhodium plating bath as defined in claim 7, wherein said free acid is selected from the group consisting of sulfuric acid, phosphoric acid and sulfamic acid.

* * * * *